US010014666B1

(12) United States Patent
Bresler

(10) Patent No.: US 10,014,666 B1
(45) Date of Patent: Jul. 3, 2018

(54) SPARK PLUG WITH AIR RECIRCULATION CAVITY

(71) Applicant: Matthew Bresler, Clarkston, MI (US)

(72) Inventor: Matthew Bresler, Clarkston, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 15/709,523

(22) Filed: Sep. 20, 2017

(51) Int. Cl.
*H01T 13/00* (2006.01)
*H01T 13/16* (2006.01)
*F02P 11/02* (2006.01)

(52) U.S. Cl.
CPC ..... *H01T 13/16* (2013.01); *F02P 11/02* (2013.01)

(58) Field of Classification Search
USPC ..... 313/11.5, 141, 118
See application file for complete search history.

(56) References Cited

U.S. PATENT DOCUMENTS 2,149,261 A * 3/1939 Anderson ..... H01T 13/16 313/11.5
4,442,807 A 4/1984 Latsch et al.
5,577,471 A 11/1996 Ward
6,215,233 B1 4/2001 Matsubara
6,531,809 B1 3/2003 Benedikt et al.
6,846,214 B1 1/2005 Gotou et al.
7,302,932 B2 12/2007 Shelby et al.
7,799,717 B2 9/2010 Walker
7,816,846 B2 10/2010 Takada et al.
8,125,130 B2 2/2012 Martin et al.
2002/0079800 A1 6/2002 Miyashita et al.
2005/0040749 A1 2/2005 Lindsay
2006/0162685 A1 7/2006 Cheng

OTHER PUBLICATIONS

Blankmeister, Matthias; Niessner, Werner; Gunther, Michael; Troger, Ralf, Grunig Carolus; Optimization of Passive Chamber Spark Plugs to Improve Lean Mixture Operation in Gas Engines; Nov. 24, 2014; pp. 323-345.
Iwatsuka, Tomohiro; Tsuga, Shunsuke; Kano, Masaru; Inoue, Yoshiki; Mori, Kiyoteru; Study on HSPI/LSPI from spark plug, JSAE, Oct. 17, 2016, pp. 745-751 (attached English translation—14 pages).

* cited by examiner

*Primary Examiner* — Vip Patel
(74) *Attorney, Agent, or Firm* — Ralph E. Smith

(57) ABSTRACT

A spark plug assembly includes a housing having an inner wall defining a bore, the housing having an open end connected to the bore, a ceramic insulator disposed within the bore and having a conical nose extending from the open end, an insulator electrode extending from the conical nose, a ground electrode coupled to and extending from the housing, wherein a spark gap is defined between the insulator electrode and the ground electrode, and a volume defined between the housing inner wall and an outer wall of the conical nose. The volume includes (i) a primary cavity, and (ii) a wide recirculation cavity defining a curved path such that gas flow entering the volume is received therein in a first direction and redirected in a second opposite direction to create an cooling airflow along the ceramic insulator and reduce a risk of low speed pre-ignition.

11 Claims, 2 Drawing Sheets

SPARK PLUG WITH AIR RECIRCULATION CAVITY

FIELD

The present application relates generally to spark plugs and, more particularly, to a spark plug having an air recirculation cavity for improved cooling.

BACKGROUND

Conventional spark plugs are inserted into a combustion chamber of an internal combustion engine and configured to produce a spark from an electric current to ignite a fuel/air mixture within the combustion chamber. However, overheating of some spark plugs in certain conditions, particularly those used in turbocharged engines, can result in low speed pre-ignition (LSPI), a phenomenon where the air/fuel mixture is ignited in the combustion chamber before intended, causing an abnormal combustion event. Such premature ignition causes excessively high pressures resulting in undesirable engine noise or even potential damage to the engine. Accordingly, while typical spark plugs work well for their intended purpose, it is desirable to improve spark plug cooling to minimize the potential influence on LSPI occurrence.

SUMMARY

According to one example aspect of the invention, a spark plug assembly is provided. The assembly includes, in one exemplary implementation, a housing having an inner wall defining a bore, the housing having an open end connected to the bore, a ceramic insulator disposed within the bore and having a conical nose extending from the open end, an insulator electrode extending from the conical nose, a ground electrode coupled to and extending from the housing, wherein a spark gap is defined between the insulator electrode and the ground electrode, and a volume defined between the housing inner wall and an outer wall of the conical nose. The volume includes (i) a primary cavity defined by the housing inner wall, the conical nose outer wall, the housing open end, and a necked down portion between the housing inner wall and the conical nose outer wall, and (ii) a wide recirculation cavity defined by the necked down portion, the housing inner wall, and the conical nose outer wall. The wide recirculation cavity defines a curved path such that gas flow entering the volume is received in the wide recirculation cavity in a first direction and redirected in a second opposite direction to create an cooling airflow along the ceramic insulator and reduce a risk of low speed pre-ignition (LSPI).

In addition to the foregoing, the described spark plug assembly may include one or more of the following features: wherein the housing inner wall defining the wide recirculation cavity includes a rounded wall portion disposed between an outwardly extending straight wall portion and a transverse straight wall portion; wherein the curved path is formed such that air entering the volume flows along the conical nose, then along the transverse straight wall portion and around the rounded wall portion, then along the outwardly extending straight wall portion and through the necked down portion, and finally along the housing inner wall before exiting the volume through the housing open end; and wherein the outwardly extending straight wall portion is oriented at an angle relative to a longitudinal axis of the housing.

In addition to the foregoing, the described spark plug assembly may include one or more of the following features: wherein the outwardly extending straight wall portion extends from the housing inner wall that defines the primary cavity; wherein the housing inner wall defining the primary cavity extends substantially parallel to the longitudinal axis of the housing; wherein the transverse straight wall portion is oriented substantially orthogonal to the longitudinal axis of the housing; wherein the angle is between approximately 15° and approximately 45°; wherein the angle is between approximately 25° and approximately 35°; wherein the angle is approximately 30°; and wherein the housing open end is open and not obstructed.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

The present application is directed to a spark plug design to improve combustion gas flow through a spark plug inner volume between a housing and insulator. The inner volume includes a wide recirculation cavity to create additional clearance between the housing and insulator. The wide recirculation cavity defines a curved path that receives gas flow entering the spark plug inner volume and redirects the gas flow in the opposite direction. This results in reduced airflow stagnation, which improves airflow and velocity.

Figure 1:
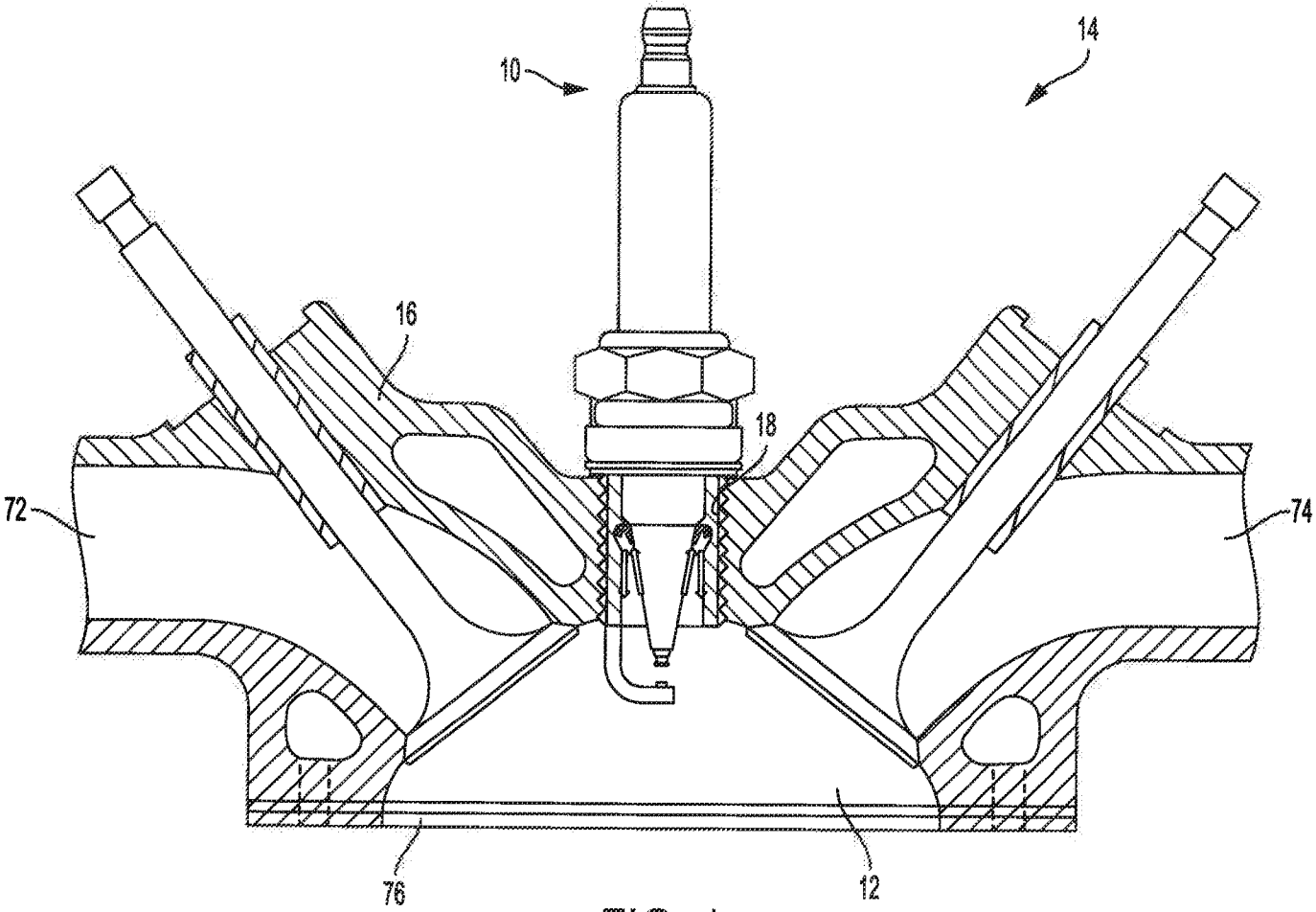
FIG. 1 is a sectional view of a portion of an example vehicle engine in accordance with the principles of the present disclosure.

With initial reference to FIG. 1, an example spark plug assembly is illustrated and generally identified at reference numeral 10. The spark plug assembly 10 is operably associated with a combustion chamber 12 of an internal combustion engine 14. As illustrated, a combustion chamber wall 16 includes a threaded bore 18 configured to threadably receive the spark plug assembly 10.

Figure 2:
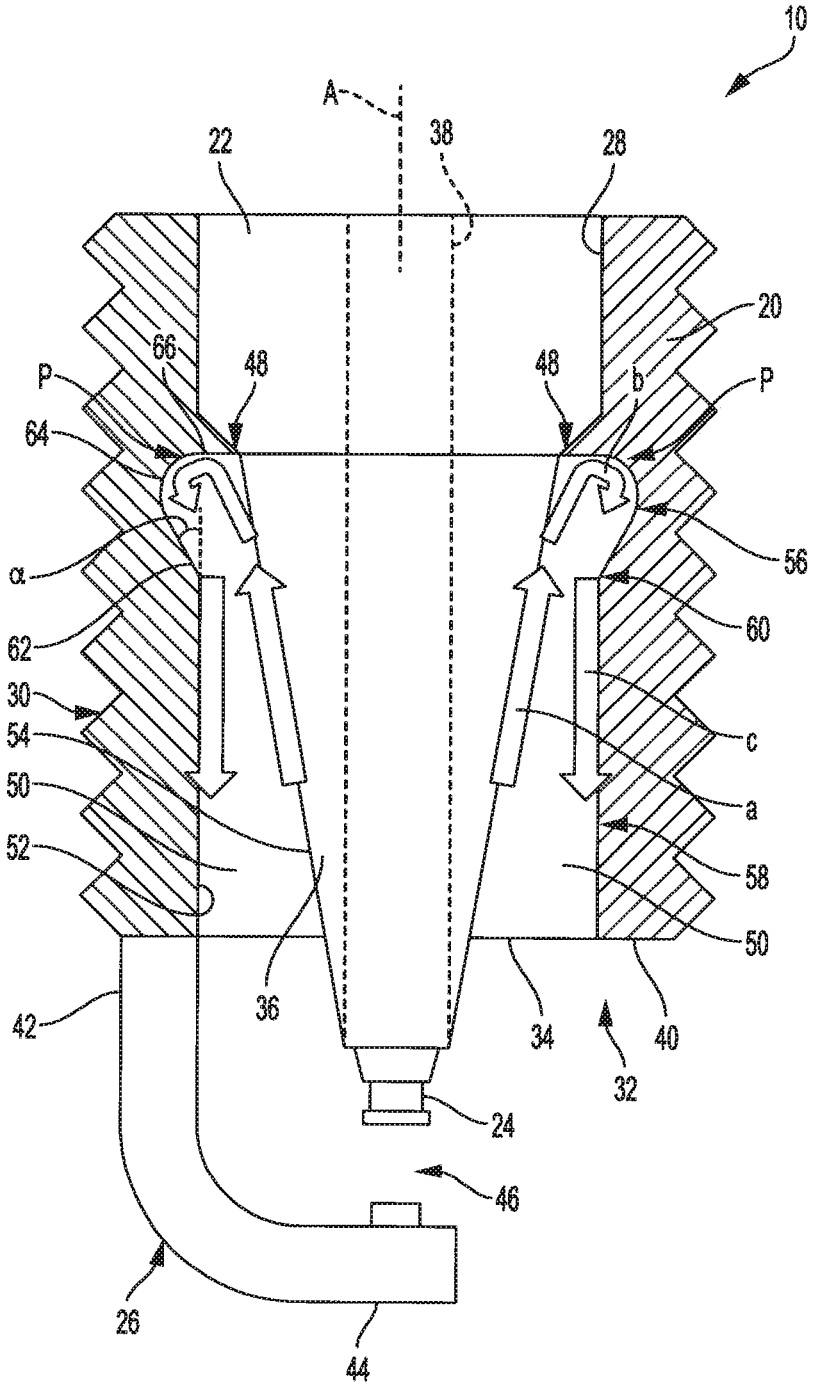
FIG. 2 is a sectional view of an example spark plug assembly in accordance with the principles of the present disclosure.

With additional reference to FIG. 2, in the example embodiment, spark plug assembly 10 generally includes a metal shell or housing 20, a ceramic insulator 22, an insulator electrode 24, and a ground electrode 26. The spark plug assembly 10 generally extends along a longitudinal axis 'A'. The shell 20 defines an axially extending bore 28 and a threaded outer surface 30. Axially extending bore 28 is configured to receive ceramic insulator 22 therein, and threaded outer surface 30 is configured to threadably couple to the combustion chamber wall threaded bore 18. In one example, at least a portion of housing 20 is crimped over ceramic insulator 22 to retain the ceramic insulator 22 within the housing.

In the example embodiment, housing 20 includes an open end 32 defining a circular aperture 34 from which ceramic insulator 22 extends. As illustrated, the open end 32 is not blocked or obstructed by any other components of the spark plug assembly 10, thereby enabling air to freely flow into and out of open end 32.

Ceramic insulator 22 is generally cylindrical and includes a conical end or nose 36 which extends out of and beyond the housing open end 32. The insulator 22 defines an axially extending bore 38 configured to receive the insulator electrode 24, which is electrically coupled to a high voltage source, for example, via an electrically conductive wire assembly (not shown).

The ground electrode 26 is electrically and mechanically coupled to a lower face 40 of the housing open end 32 and extends downwardly therefrom. As shown in the illustrated embodiment, the ground electrode 26 is generally L-shaped and includes an axial portion 42 and a transverse portion 44. The axial portion 42 extends from the lower face 40 and is parallel or substantially parallel to longitudinal axis 'A'. Transverse portion 44 is coupled to and extends from the axial portion 42 orthogonal or substantially orthogonal to the longitudinal axis 'A'. In this way, the exposed insulator electrode 24 extends from nose cone 36 and is oriented proximate the ground electrode 26 to define a spark gap 46.

In the example embodiment, an inner volume 50 is defined in the housing open end 32 between a housing inner wall 52 and an outer wall 54 of the insulator cone 36. Some conventional spark plugs only have narrow volumes defined between the housing and the insulator, which can result in high stagnation pressures in the volume that prevent airflow into and within the volume. Accordingly, such low air flow within the volume results in low insulator cooling and leaves the conventional spark plug and vehicle engine at increased risk for LSPI.

Accordingly, to facilitate preventing such high stagnation pressures, spark plug assembly 10 includes volume 50 with a wide recirculation cavity 56 at a convergence or junction 48 between housing inner wall 52 and insulator cone outer wall 54. This recirculation cavity 56 is configured to create a low stagnation pressure zone and promote higher airflow and airflow velocity within recirculation cavity 56 and volume 50. The higher airflow and airflow velocity results in high insulator cooling and dramatically reduces the risk of LSPI for spark plug assembly 10 and engine 14.

As show in FIG. 2, inner volume 50 includes a primary cavity 58 and the wide recirculation cavity 56. Primary cavity 58 is fluidly coupled to wide recirculation cavity 56 and has a generally triangular cross-section. Primary cavity 58 is defined between housing inner wall 52, insulator cone outer wall 54, housing lower face 40, and a necked down portion 60 between walls 52, 54. In the primary cavity 58, housing inner wall 52 is parallel to or substantially parallel to longitudinal axis 'A', and insulator cone outer wall 54 converges as it extends from the housing/cone junction 48 toward the housing lower face 40.

In the example implementation, the wide recirculation cavity 56 is generally defined between housing inner wall 52, insulator cone outer wall 54, and necked down portion 60. However, as illustrated, the housing inner wall 52 includes an angled or outwardly extending straight wall portion 62, a rounded wall portion 64, and a transverse straight wall portion 66 to partially define the wide recirculation cavity 56.

As shown in FIG. 2, in the example embodiment, straight wall portion 62 extends outwardly from the housing inner wall of the primary cavity 58 at an angle '$\alpha$' relative to axis 'A'. In one example, angle '$\alpha$' is between approximately 15° and approximately 45°, or between 15° and 45°. In another example, angle '$\alpha$' is between approximately 25° and approximately 35°, or between 25° and 35°. In yet another example, angle '$\alpha$' is 30° or approximately 30°.

In the example implementation, the transverse straight wall portion 66 extends from junction 48 in an orientation orthogonal to or substantially orthogonal to axis 'A'. Rounded wall portion 64 extends between straight wall portions 62, 66 with a radius of curvature 'R'.

As shown in FIG. 2, spark plug assembly 10 includes the wide recirculation cavity 56 at the point 48 wherein the insulator nose cone 36 and housing 20 come into contact to seal the combustion gases. In this way, the recirculation cavity 56 creates additional clearance between insulator nose cone 36 and housing 20 proximate the junction 48. As illustrated, the wide recirculation cavity 56 defines a curved path 'P' such that gas flow entering the spark plug volume 50 (arrow 'a') is redirected along the curved path (arrow 'b') and flowed in the opposite direction (arrow 'c') along the housing inner wall 52 and out of housing open end 32.

Accordingly, the wide recirculation cavity 56 promotes improved airflow through volume 50, which improves heat transfer by introducing convectional cooling airflow along the spark plug insulator 22, thereby improving cooling at the nose cone 36. This improved cooling thus lowers the risk of the spark plug insulator 22 being a source of LSPI.

In operation, the spark plug assembly 10 is configured to be installed in the internal combustion engine 14 with a spark-emitting end 70 exposed inside the combustion chamber 12. The combustion chamber 12 is configured to receive an air/fuel mixture via an intake port 72 and to direct combustion gases out of the chamber via an exhaust port 74. The insulator electrode 24 receives a high voltage from an ignition coil (not shown), and the high voltage travels to the insulator electrode 24 and bridges the spark gap 46 such that a spark is formed between insulator electrode 24 and the ground electrode 26, which is grounded to the engine 14. The air/fuel mixture from intake port 72 is subsequently ignited by the spark, thereby causing a combustion event and driving engine cylinders 76 to move the vehicle.

Described herein are systems and methods for a spark plug design to improve combustion gas flow through a spark plug inner volume between a housing and insulator. The inner volume includes a wide recirculation cavity to create additional clearance between the housing and insulator. The wide recirculation cavity defines a curved path that receives gas flow entering the spark plug and redirects the gas flow in the opposite direction to reduce airflow stagnation, thereby establishing both improved airflow and improved airflow velocity. Thus, the described spark plug assembly improves heat transfer to the combustion gases which allows for the selection of a spark plug heat range hotter than would normally be allowed due to the risk of low speed-pre-ignition.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. A spark plug assembly comprising:

a housing having an inner wall defining a bore, the housing having an open end connected to the bore;

a ceramic insulator disposed within the bore and having a conical nose extending from the open end;

an insulator electrode extending from the conical nose;

a ground electrode coupled to and extending from the housing, wherein a spark gap is defined between the insulator electrode and the ground electrode;

a volume defined between the housing inner wall and an outer wall of the conical nose, the volume comprising:

(i) a primary cavity defined by the housing inner wall, the conical nose outer wall, the housing open end, and a necked down portion between the housing inner wall and the conical nose outer wall; and (ii) a wide recirculation cavity defined by the necked down portion, the housing inner wall, and the conical nose outer wall, wherein the wide recirculation cavity defines a curved path such that gas flow entering the primary cavity is then received in the wide recirculation cavity in a first direction and redirected by the wide recirculation cavity in a second opposite direction to create an cooling airflow along the ceramic insulator and reduce a risk of low speed pre-ignition (LSPI).

2. The assembly of claim 1, wherein the housing inner wall defining the wide recirculation cavity includes a rounded wall portion disposed between an outwardly extending straight wall portion and a transverse straight wall portion.

3. The assembly of claim 2, wherein the curved path is formed such that air entering the volume flows along the conical nose, then along the transverse straight wall portion and around the rounded wall portion, then along the outwardly extending straight wall portion and through the necked down portion, and finally along the housing inner wall before exiting the volume through the housing open end.

4. The assembly of claim 2, wherein the outwardly extending straight wall portion is oriented at an angle relative to a longitudinal axis of the housing.

5. The assembly of claim 4, wherein the outwardly extending straight wall portion extends outwardly from the housing inner wall that defines the primary cavity.

6. The assembly of claim 5, wherein the housing inner wall defining the primary cavity extends substantially parallel to the longitudinal axis of the housing.

7. The assembly of claim 4, wherein the transverse straight wall portion is oriented substantially orthogonal to the longitudinal axis of the housing.

8. The assembly of claim 4, wherein the angle is between approximately 15° and approximately 45°.

9. The assembly of claim 8, wherein the angle is between approximately 25° and approximately 35°.

10. The assembly of claim 9, wherein the angle is approximately 30°.

11. The assembly of claim 1, wherein the housing open end is open and not obstructed.

* * * * *